US008339336B2

(12) United States Patent
Goden et al.

(10) Patent No.: US 8,339,336 B2
(45) Date of Patent: Dec. 25, 2012

(54) CIRCUIT DEVICE AND ACTIVE-MATRIX DISPLAY APPARATUS

(75) Inventors: Tatsuhito Goden, Kawasaki (JP); Somei Kawasaki, Saitama (JP); Masami Iseki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1074 days.

(21) Appl. No.: 12/256,919

(22) Filed: Oct. 23, 2008

(65) Prior Publication Data

US 2009/0109144 A1 Apr. 30, 2009

(30) Foreign Application Priority Data

Oct. 29, 2007 (JP) ..... 2007-280441

(51) Int. Cl.
*G09G 3/30* (2006.01)

(52) U.S. Cl. ..... 345/76; 345/82; 345/100

(58) Field of Classification Search ..... 345/76–83, 345/92, 98–100; 315/169.1–169.4
See application file for complete search history.

(56) References Cited

U.S. PATENT DOCUMENTS

| | | | | |
|---|---|---|---|---|
| 5,302,871 | A | 4/1994 | Matsuzaki et al. | |
| 5,555,000 | A * | 9/1996 | Sarrasin et al. | 345/75.2 |
| 5,963,184 | A | 10/1999 | Tokunaga et al. | |
| 6,188,378 | B1 | 2/2001 | Yamamoto et al. | |
| 6,335,720 | B1 | 1/2002 | Mori et al. | |
| 6,348,910 | B1 | 2/2002 | Yamamoto et al. | |
| 6,373,454 | B1 | 4/2002 | Knapp et al. | |
| 6,552,709 | B1 | 4/2003 | Yamaguchi | |
| 6,559,824 | B1 | 5/2003 | Kubota et al. | |
| 6,587,086 | B1 | 7/2003 | Koyama | |
| 6,661,180 | B2 | 12/2003 | Koyama | |
| 7,126,565 | B2 | 10/2006 | Kawasaki et al. | |
| 7,242,397 | B2 | 7/2007 | Iseki et al. | 345/204 |
| 7,253,812 | B2 | 8/2007 | Sasaki | |
| 7,259,735 | B2 | 8/2007 | Kasai | |
| 7,532,207 | B2 | 5/2009 | Kawasaki et al. | |
| 7,605,899 | B2 | 10/2009 | Shikina et al. | |
| 7,692,643 | B2 | 4/2010 | Kawasaki et al. | |
| 7,812,812 | B2 | 10/2010 | Yoshinaga et al. | |
| 7,911,425 | B2 | 3/2011 | Goden et al. | |
| 7,936,329 | B2 * | 5/2011 | Iriguchi et al. | 345/99 |
| 2002/0047581 | A1 | 4/2002 | Koyama | |

(Continued)

FOREIGN PATENT DOCUMENTS

| | | |
|---|---|---|
| CN | 1521719 A | 8/2004 |

(Continued)

*Primary Examiner* — Kimnhung Nguyen
(74) *Attorney, Agent, or Firm* — Fitzpatrick, Cella, Harper & Scinto

(57) ABSTRACT

An active-matrix display apparatus includes an image display unit in which pixels are arranged in a matrix in row and column directions, a column control circuit group including thin-film transistors, the column control circuit group being configured to output a data signal to columns of the pixels, and a control-signal generating circuit including a thin-film transistor, with the control-signal generating circuit being configured to output a first control signal controlling the column control circuit group. The column control circuit group is controlled by the first control signal and a second control signal delayed from the first control signal, and the first control signal is generated by the control-signal generating circuit, then input into the column control circuit group, and then propagated through the column control circuit group. The second control signal is generated on the basis of the first control signal which has been propagated through the column control circuit group.

8 Claims, 13 Drawing Sheets

U.S. PATENT DOCUMENTS

| | | | | |
|---|---|---|---|---|
| 2003/0058687 | A1 | 3/2003 | Kimura | |
| 2004/0155843 | A1 | 8/2004 | Sasaki | |
| 2004/0183752 | A1 | 9/2004 | Kawasaki et al. | 345/20 |
| 2005/0007316 | A1 | 1/2005 | Akimoto et al. | |
| 2005/0007319 | A1 | 1/2005 | Shin et al. | |
| 2005/0041002 | A1 | 2/2005 | Takahara et al. | |
| 2005/0122150 | A1 | 6/2005 | Iseki et al. | 327/215 |
| 2005/0285151 | A1 | 12/2005 | Kawasaki | 257/213 |
| 2006/0061529 | A1 | 3/2006 | Kim | |
| 2006/0114194 | A1 | 6/2006 | Kawasaki et al. | 345/76 |
| 2006/0114195 | A1 | 6/2006 | Yamashita et al. | 345/76 |
| 2006/0132395 | A1 | 6/2006 | Kawasaki et al. | 345/75.2 |
| 2006/0187185 | A1 | 8/2006 | Yoshinaga et al. | |
| 2006/0267509 | A1 | 11/2006 | Yang | |
| 2007/0132719 | A1 | 6/2007 | Yamashita et al. | |
| 2007/0242002 | A1* | 10/2007 | Kawabe | 345/76 |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0042945 | A1* | 2/2008 | Mutsukura et al. | 345/77 |
| 2008/0157828 | A1 | 7/2008 | Kawasaki et al. | 327/108 |
| 2008/0158112 | A1 | 7/2008 | Kawasaki et al. | 345/76 |
| 2008/0259000 | A1 | 10/2008 | Kawasaki | 345/55 |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0135110 | A1 | 5/2009 | Nakamura et al. | |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0001689 | A1 | 1/2011 | Maru et al. | |
| 2011/0025653 | A1 | 2/2011 | Ikeda et al. | |

FOREIGN PATENT DOCUMENTS

| | | | |
|---|---|---|---|
| CN | 1770246 | A | 5/2006 |
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2004-3411144 | A | 12/2004 |
| JP | 2006-030516 | A | 2/2006 |
| JP | 2005-157322 | A | 6/2006 |
| JP | 2008-268981 | A | 11/2008 |
| JP | 2008-015516 | A | 12/2008 |

* cited by examiner

CIRCUIT DEVICE AND ACTIVE-MATRIX DISPLAY APPARATUS

BACKGROUND OF THE INVENTION

1. Field of the Invention

The present invention relates to a circuit device including a thin-film transistor (hereinafter abbreviated to a TFT). The present invention also relates to an active-matrix display apparatus having a circuit device including a TFT.

2. Description of the Related Art

In recent years, attention is being given to a light-emitting display apparatus using a light-emitting element as a next-generation display apparatus. In particular, a display apparatus using an organic electroluminescent (EL) element, which is a current-controlled light-emitting element whose emission luminance is controlled by a current, i.e., a so-called organic EL display apparatus, is known. One type of organic EL display apparatus is an active matrix display apparatus, which uses TFTs in a display region and a peripheral circuit and controls emission of light of organic EL elements by use of the TFTs. One known driving method used in the active-matrix display apparatus is a current programming technique of setting a current whose magnitude corresponds to image data in a pixel circuit disposed in a pixel and causing an organic EL element to emit light. The current corresponding to image data is output from a column control circuit. One example of the column control circuit is proposed in U.S. Pat. No. 7,126,565.

FIG. 12 illustrates the configuration of a column control circuit described in the above patent document. The column control circuit illustrated in FIG. 12 includes two voltage-to-current converters $GM_a$ and $GM_b$. In operation, generally, while one of the two voltage-to-current converters $GM_a$ and $GM_b$ outputs current data, the other one samples an image signal and sets the current data. In this drawing, references $M_1$ to $M_4$, $M_6$ to $M_{10}$, and $M_{12}$ represent n-type TFTs, references $M_5$ and $M_{11}$ represent p-type TFTs, references $C_1$ to $C_4$ represent capacitors, reference GND represents a first power source, and reference VCC represents a second power source. Reference Video represents an image signal, references $SP_a$ and $SP_b$ represent sampling signals, and references $P_1$ to $P_6$ represent control signals. The relationship between the gate sizes (width: W, length: L) in the transistors and that between the capacitances are that $M_1=M_7$, $M_2=M_8$, $M_3=M_9$, $M_4=M_{10}$, $M_5=M_{11}$, $M_6=M_{12}$, $C_1=C_3$, and $C_2=C_4$.

In FIG. 12, a case is described in which the channel characteristic of each TFT is specified, for example, the channel characteristic of $M_1$ is the n type, and that of $M_5$ is the p type. However, this is merely an example. If the relationship between the potential of the first power source GND and that of the second power source VCC is changed or the channel characteristics of the TFTs are inverted, the configuration may be changed as needed in response to the change or inversion.

For the sake of convenience of explanation in this specification, the gate electrode, source electrode, and drain electrode of a TFT are represented by the abbreviations /G, /S, and /D, respectively, and a signal and a signal line used for supplying the signal are represented without being distinguished.

FIG. 13 is a timing diagram for describing an operation of the column control circuit illustrated in FIG. 12. FIG. 13 illustrates an operation occurring in three horizontal scanning periods for an image signal, in other words, an operation corresponding to three columns (three horizontal scanning periods) for an organic EL display apparatus. Time $t_1$ to time $t_7$ (time $t_7$ to time $t_{13}$) corresponds to one horizontal scanning period.

The operation will be described below with reference to FIG. 13 while the attention is focused on the voltage-to-current converter $GM_a$. The operation (1) to (6) described below is performed in sequence.

(1) Preliminary Charging (time $t_1$ to time $t_2$)

$M_3$/G is charged by $M_5$.

(2) Threshold Voltage $V_{th}$ Resetting (time $t_2$ to time $t_3$)

$M_3$/G is self-discharged such that the voltage approaches its threshold voltage $V_{th}$.

(3) Waiting for Sampling (time $t_4$ to time $t_5$)

The circuit waits in a state where the voltage of $M_3$/G is adjacent to its threshold voltage $V_{th}$ until a sampling signal $SP_a$ is input. At this time, the current of $M_3$/D is substantially zero.

(4) Sampling (time $t_5$ to time $t_6$)

The sampling signal $SP_a$ for a corresponding column is generated, and the voltage of $M_3$/G maintained adjacent to its threshold voltage $V_{th}$ is changed by a transition voltage $\Delta V_1$ by an image signal level $d_1$ with reference to a blanking level at this point in time.

(5) Waiting for Outputting (time $t_6$ to time $t_7$)

The circuit waits in a state where the voltage of $M_3$/G set by sampling of the image signal is maintained. At this time, the current of $M_3$/D driven by the voltage of $M_3$/G is passed from $M_5$.

(6) Current Outputting (time $t_7$ to time $t_{13}$)

The current of $M_3$/D driven by the voltage of $M_3$/G is output to $I_{data}$ as current data.

After (6) (on and after time $t_{13}$), the same operation is repeated from (1). The voltage-to-current converter $GM_b$ outputs a current (operation (6)) during the period from (1) to (5) (time $t_1$ to time $t_7$) and performs the operation (1) to (5) relating to setting of current data during the period (6) (time $t_7$ to time $t_{13}$).

As illustrated in the timing diagram of FIG. 13, this column control circuit operates with a plurality of control signals ($P_1$ to $P_6$) necessary for timing control. One example of the timing control is the control for causing the fall of a sampling signal $SP_a$ to occur after a fall of a control signal $P_1$ in the period from time $t_3$ to $t_4$. This control is performed in order to cause $M_3$/G to self-discharge stably by fixing a first terminal of the capacitor $C_1$ at the potential of the image signal Video during resetting of the threshold voltage $V_{th}$. If the fall of the sampling signal $SP_a$ occurs in advance of the fall of the control signal $P_1$, the voltage across the capacitor $C_1$ is not changed even when the potential of $M_3$/G is changed by self-discharging during that period. That is, the voltage of the capacitor $C_1$ stored after the self-discharging is larger than the threshold voltage $V_{th}$ of $M_3$. To avoid this situation, it is necessary to delay the time of the fall of $SP_a$ from the time of the fall of $P_1$. The same applies to the operation of $P_4$ and $SP_b$ in the period from time $t_9$ to $t_{10}$ and the operation of $P_1$ and $SP_a$ in the period from $t_{15}$ to $t_{16}$. No such limitation is imposed on the time of the rise of $SP_a$ and that of $SP_b$. This is because, in the operation of preliminary charging (time $t_1$ to time $t_2$), if the rise of $SP_a$ is delayed from after that of $P_1$ or $P_2$, the preliminary charging into the capacitor $C_1$ is not affected. One known method for delaying a signal from another signal is one that uses a delay circuit. U.S. Pat. No. 5,302,871 discloses a delay circuit in which a plurality of inverters, each including a plurality of transistors, are connected together. With the delay circuit, the time of the rise of a signal and the time of the fall of a signal are different at the input side and at the output side.

However, if a transistor, in particular, a TFT is used to control delay of a signal, because the characteristics vary, the driving characteristics of inverters or the values of capacitors vary. Because a control signal is input in parallel into column control circuits corresponding to the number of columns, the wiring for supplying the signal has a large time constant, so the signal is delayed. Therefore, when it is necessary to supply a plurality of control signals at slightly different times, a problem arises in which the times of the rises of the control signals or the times of the falls thereof may be inverted, and thus a desired operation may be unachievable.

SUMMARY OF THE INVENTION

The present invention provides a driving circuit capable of causing at least one of the rises of a plurality of control signals and the falls thereof to occur in a desired sequence without using a traditional delay circuit and also provides an active-matrix display apparatus that uses the driving circuit.

According to an aspect of the present invention, a circuit device includes a first circuit including a thin-film transistor and a second circuit including a thin-film transistor. The first circuit outputs control signals for controlling the second circuit, the control signals including a first control signal to be propagated through the second circuit and a second control signal delayed from the first control signal. The second control signal is generated on the basis of the first control signal which has been propagated through the second circuit.

According to another aspect of the present invention, an active-matrix display apparatus includes an image display unit in which pixels are arranged in a matrix in row and column directions, a column control circuit group including thin-film transistors, the column control circuit group being configured to output a data signal to columns of the pixels, and a control-signal generating circuit including a thin-film transistor, the control-signal generating circuit being configured to output a first control signal controlling the column control circuit group. The column control circuit group is controlled by the first control signal and a second control signal delayed from the first control signal. The first control signal is generated by the control-signal generating circuit, then input into the column control circuit group, and then propagated through the column control circuit group. The second control signal is generated on the basis of the first control signal which has been propagated through the column control circuit group.

In accordance with the present invention, at least one of the rises of a plurality of control signals and the falls thereof can occur in a desired sequence without consideration of the characteristics of TFTs and time constant of wiring by generation of a control signal using another control signal propagated through a circuit including a TFT. Accordingly, fine timing control can be performed reliably, and a highly reliable driving circuit that ensures accurate operation and an active-matrix display apparatus that uses the driving circuit can be provided.

Further features of the present invention will become apparent from the following description of exemplary embodiments (with reference to the attached drawings).

DESCRIPTION OF THE EMBODIMENTS

Best mode for carrying out a display apparatus according to the present invention regarding first to third embodiments is specifically described below with reference to the accompanying drawings. The embodiments described below are applied to a driving circuit including a TFT and to an active-matrix display apparatus that uses the driving circuit and can reliably perform timing control for a control signal.

It is noted that n-type and p-type polysilicon TFTs (poly-Si TFTs) can be used as the TFTs described in the embodiments. An active-matrix organic EL display apparatus is described below by way of example, but the display apparatus of the present invention is not limited to this type. The display apparatus can be of any type as long as displaying of each pixel is controllable by a current signal.

First Embodiment

Figure 1:
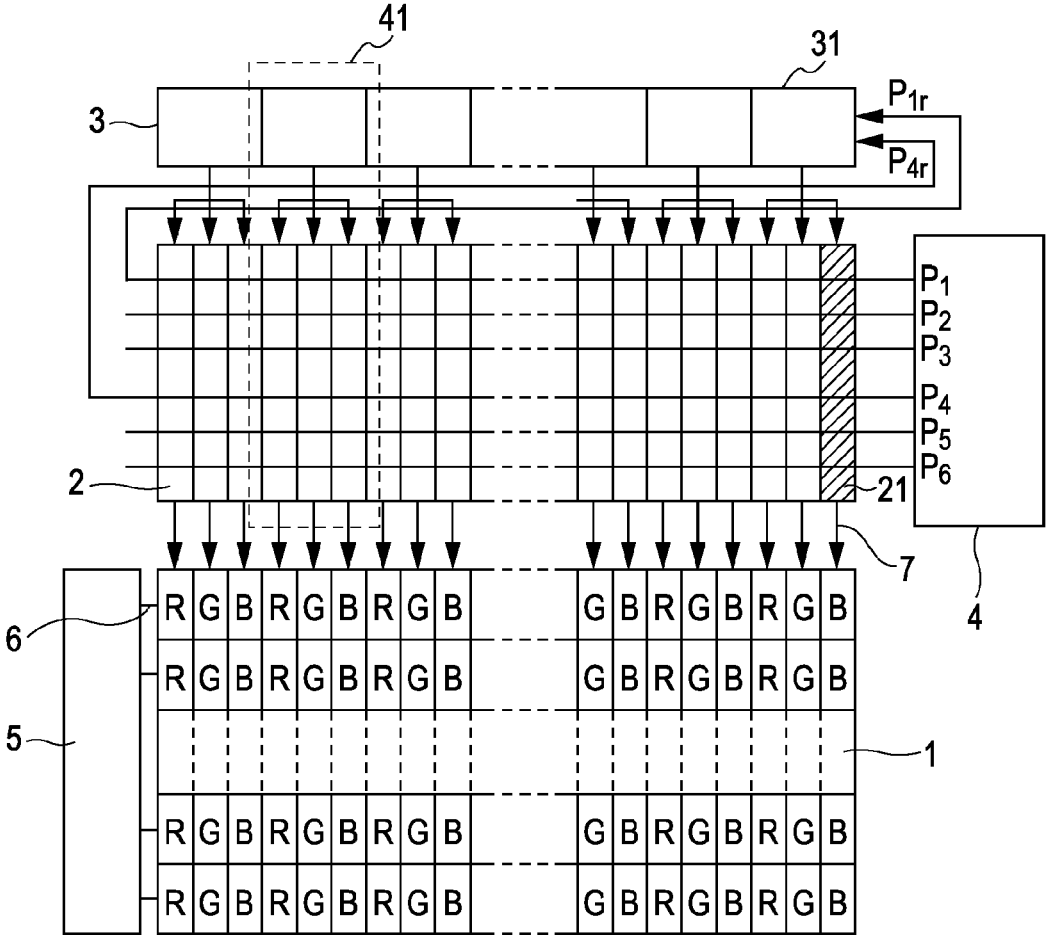
FIG. 1 is a circuit configuration of a display apparatus according to a first embodiment of the present invention.

FIG. 1 illustrates a circuit configuration of a circuit device according to the present embodiment. In FIG. 1, reference numeral 1 represents an image display portion, reference numeral 2 represents a column control circuit group, reference numeral 3 represents a sampling-signal generating circuit, reference numeral 4 represents a control-signal generating circuit, reference numeral 5 represents a row control circuit, reference numeral 6 represents a scanning line (light-emitting period control line), and reference numeral 7 represents a data line. The control-signal generating circuit 4 corresponds to a first circuit included in the circuit device described in the present invention, and the column control circuit group 2 corresponds to a second circuit included in the circuit device described in the present invention.

In the image display portion 1, a plurality of pixels are arranged in a plane. The pixels are arranged in a matrix in the row and column directions within the image display portion 1. Each of the pixels has a group of organic EL elements consisting of an organic EL element emitting light for red (hereinafter referred to as an R element), that for green (hereinafter referred to as a G element), and that for blue (hereinafter referred to as a B element) to emit light for displaying an image in full color. The pixel has a pixel circuit including a TFT for each of the organic EL elements, the TFT controlling a current to be input into the organic EL element. The organic EL element has a pair of electrodes and an organic light-emitting layer disposed between the pair of electrodes. When a current supplied from the pixel circuit is passed through the organic light-emitting layer disposed between the pair of electrodes, light is emitted in accordance with the amount of the current passing through the organic light-emitting layer.

The column control circuit group 2, the sampling-signal generating circuit 3, the control-signal generating circuit 4, and the row control circuit 5 are disposed in the vicinity of the image display portion 1.

Figure 12:
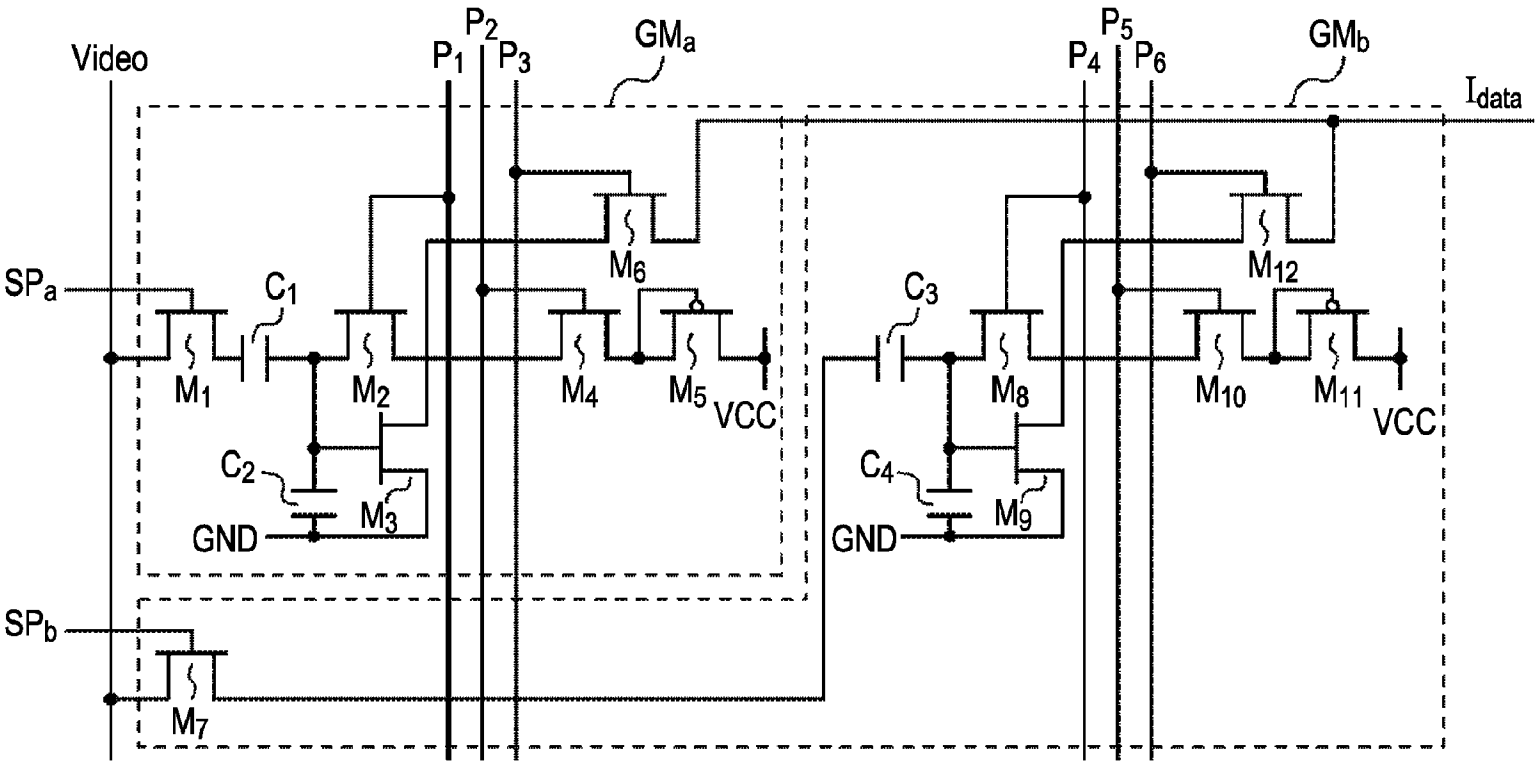
FIG. 12 illustrates a configuration of a column control circuit in the related art.

The column control circuit group 2 is a group of column control circuits, each of which outputs a data signal to a column. A column control circuit 21, which is hatched in FIG. 1, corresponds to a single column. The column control circuit 21 is the circuit illustrated in FIG. 12. Although being omitted in FIG. 1, an image signal Video is input into the column control circuit group 2, as illustrated in FIG. 12. A current data $I_{data}$ (data signal) is output from each output terminal to each column in the image display portion 1. The current data (data signal) is input via the data line 7 into a corresponding pixel circuit in the image display portion 1. The configuration and operation of the column control circuit 21 are substantially the same as in those previously described with reference to FIG. 12. The timing diagram of the operation is also substantially the same as in FIG. 13.

Figure 13:
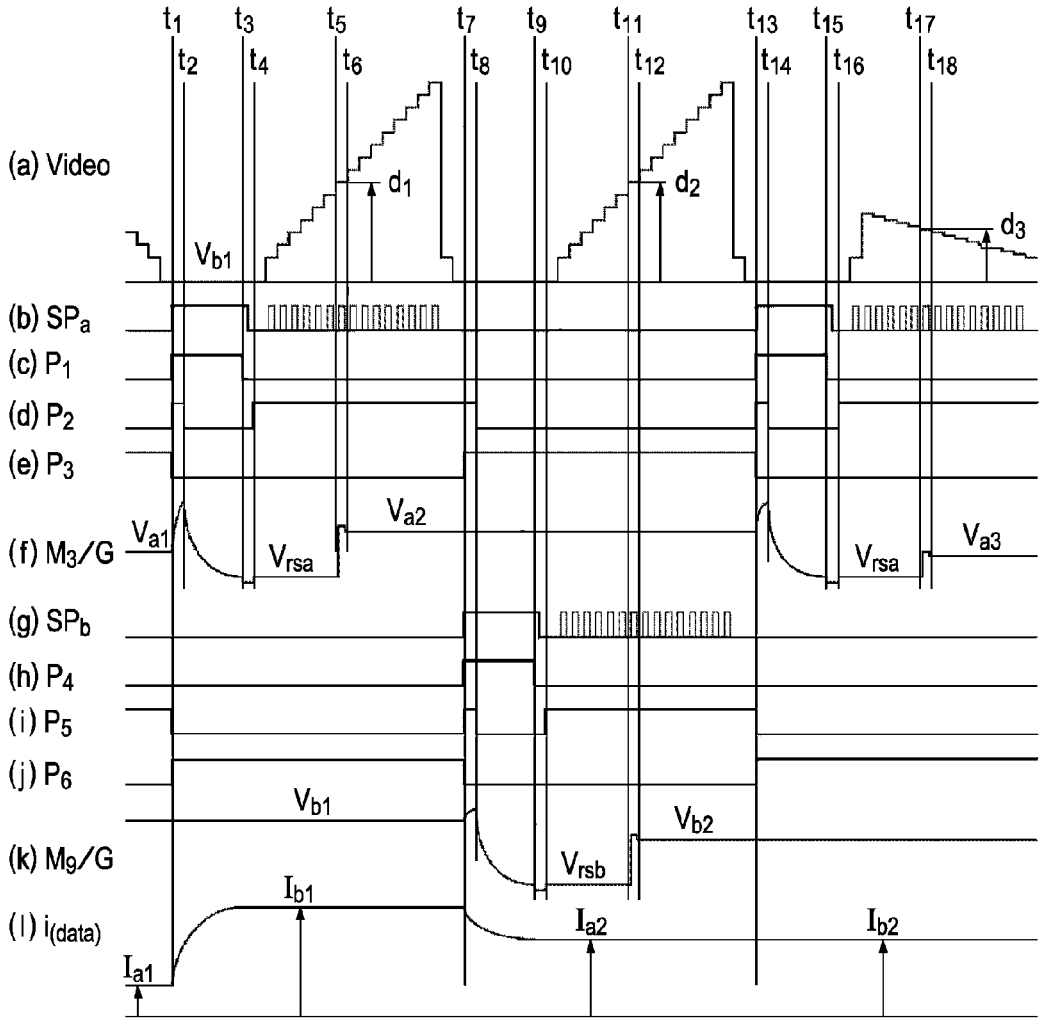
FIG. 13 is a timing diagram for describing an operation of the column control circuit illustrated in FIG. 12.

Referring back to FIG. 1, the control-signal generating circuit 4 outputs control signals ($P_1$ to $P_6$) having the waveforms illustrated in FIG. 13 and inputs them into the column control circuit group 2. The control signals $P_1$ to $P_6$ correspond to a first control signal for the circuit device according to the present invention. When the organic EL elements for three colors R, G, and B constitute a single pixel and pixels are arranged in m columns in the image display portion 1, i.e., m pixels are arranged in the horizontal direction of the drawing (row direction), because one column control circuit 21 is provided for each column, the total number of the column control circuits 21 arranged is n (n=3 m). The image signal Video is input into the column control circuit group 2 as a parallel signal for three columns in total (one for each of R, G, and B). Therefore, the sampling signal is common to the three column control circuits 21 for RGB. The sampling-signal generating circuit 3 has m output terminals, one for each of parts 31. The sampling signal is supplied from one output terminal to the three column control circuits 21. The control signals ($P_1$ to $P_6$) are generated by the control-signal generating circuit 4 in synchronization with each other and are input into the n column control circuits 21 so as to be common thereto. That is, after the control signals ($P_1$ to $P_6$) are output from the control-signal generating circuit 4, they are propagated from the nearest column control circuit toward the farthest column control circuit (in FIG. 1, from right to left) while being delayed.

The control signals $P_1$ and $P_4$ are propagated through the farthest column control circuit 21 (in FIG. 1, the column control circuit 21 at the leftmost side in the drawing) and then input into one terminal of the sampling-signal generating circuit 3 through routed signal lines. The control signals $P_1$ and $P_4$ after passing through the routed signal lines are represented by control signals $P_{1r}$ and $P_{4r}$.

Figure 2:
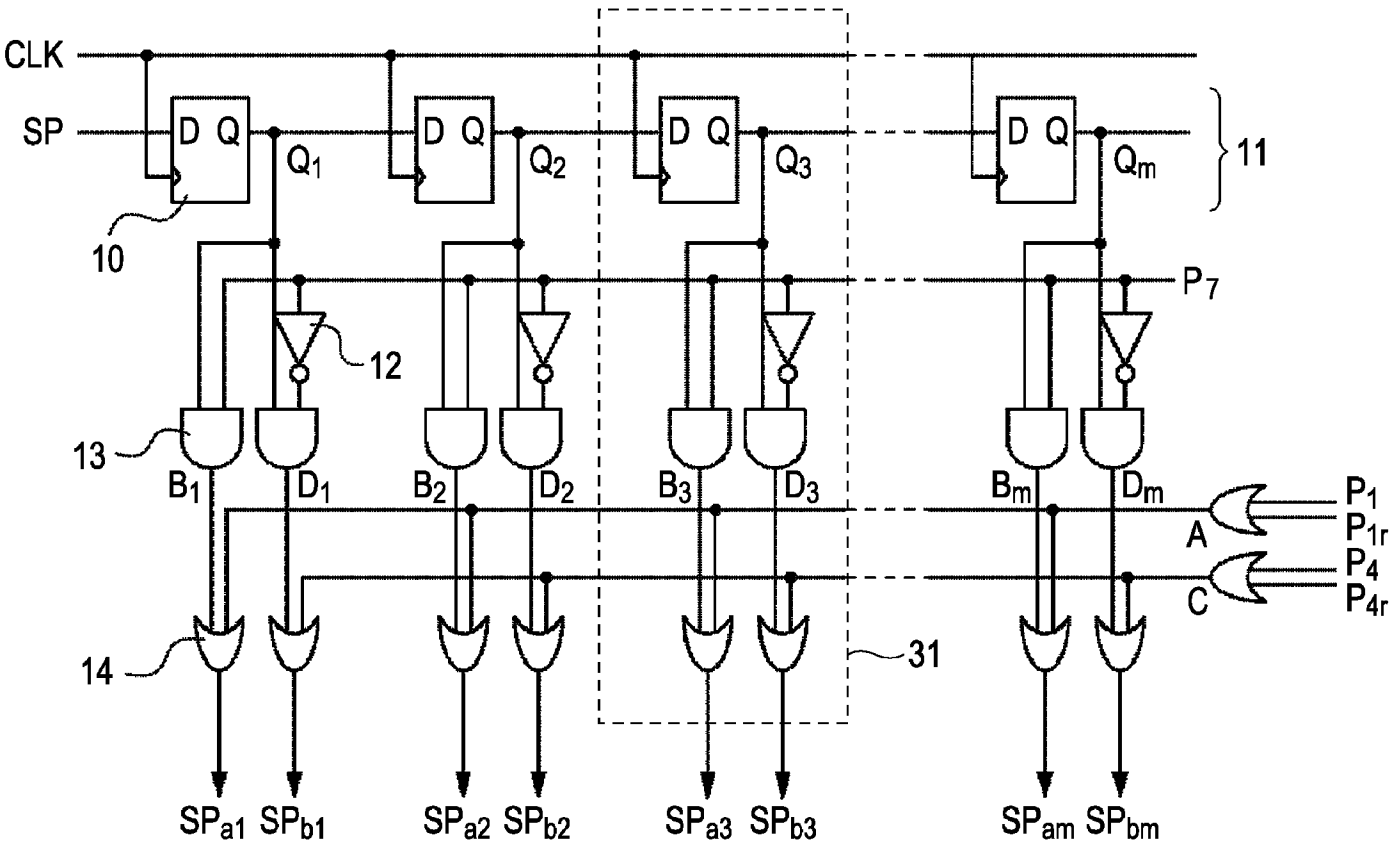
FIG. 2 illustrates one example configuration of a sampling-signal generating circuit according to the first embodiment.

FIG. 2 illustrates one example configuration of the sampling-signal generating circuit 3. The part 31 corresponding to one output terminal of the sampling-signal generating circuit 3, the part 31 being surrounded by broken lines in FIG. 2, includes a flip-flop 10, a NOT gate (inverter) 12, two AND gates 13, and two OR gates 14. The output of the flip-flop 10 is connected as the input of the following stage. The flip-flops 10 constitute a shift register 11. In the sampling-signal generating circuit 3, the shift register 11 outputs $Q_1$ to $Q_m$, $P_1$, $P_4$, $P_{1r}$, $P_{4r}$, and $P_7$ by transferring a start pulse SP with a clock CLK, and these outputs are input into the logic circuit constituted by the NOT gate 12, the AND gates 13, and the OR gates 14. The logic circuit outputs the sampling signals $SP_a$ ($SP_{a1}$ to $SP_{am}$) and $SP_b$ ($SP_{b1}$ to $SP_{bm}$). In the present embodiment, the sampling signals $SP_a$ ($SP_{a1}$ to $SP_{am}$) and $SP_b$ ($SP_{b1}$ to $SP_{bm}$) correspond to a second control signal in the circuit device according to the present invention. The control signal $P_7$ is the signal for controlling the sampling signals $SP_a$ and $SP_b$ such that they are alternately output for each one horizontal scanning period for an image signal.

Figure 3:
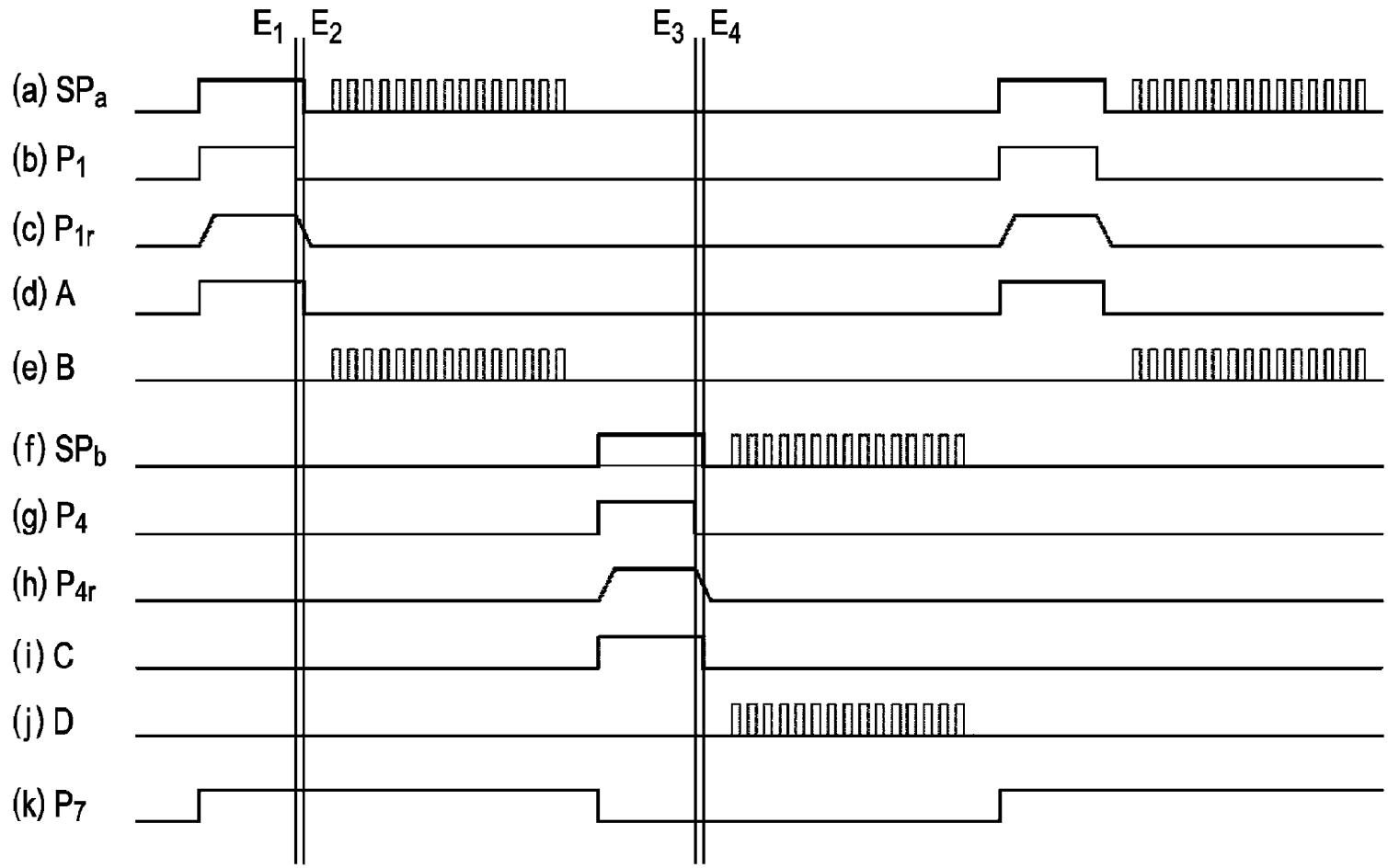
FIG. 3 is a timing diagram for describing an operation of the sampling-signal generating circuit illustrated in FIG. 2.

FIG. 3 is a timing diagram that illustrates an operation of the sampling-signal generating circuit 3 illustrated in FIG. 2. In FIG. 3, (a) to (k) represent the waveforms at the nodes of the symbols illustrated in FIG. 2. (a) represents the waveform of $SP_a$ ($SP_{a1}$ to $SP_{am}$ are referred to collectively as $SP_a$), (b) represents that of $P_1$, (c) represents that of $P_{1r}$, (d) represents that of A, (e) represents that of B ($B_1$ to $B_m$ are referred to collectively as B), (f) represents that of $SP_b$ ($SP_{b1}$ to $SP_{bm}$ are referred to collectively as $SP_b$), (g) represents that of $P_4$, (h) represents that of $P_{4r}$, (i) represents that of C, (j) represents that of D ($D_1$ to $D_m$ are referred to collectively as D), and (k) represents that of $P_7$. Because the signals (c) $P_{1r}$ and (h) $P_{4r}$ have been propagated through the n column control circuits, the rise and the fall in their waveforms are less steep, and the signals (c) $P_{1r}$ and (h) $P_{4r}$ are delayed from the signals (b) $P_1$ and (g) $P_4$. Therefore, the edges of the fall in the waveforms (d) A and (i) C occur after those in the waveforms (b) $P_1$ and (g) $P_4$.

In such a way, the edge of the fall of (c) $P_{1r}$, which is the signal in which the fall of (b) $P_1$ has been reliably propagated through all of the n column control circuits, causes the edge $E_2$ of the fall of (a) $SP_a$ to occur. Therefore, it is ensured that the edge $E_2$ of the fall in (a) $SP_a$ occurs after the edge $E_1$ of the fall in (b) $P_1$ in all of the n column control circuits. Additionally, the edge of the fall of (h) $P_{4r}$, which is the control in which the fall of (g) $P_4$ has been reliably propagated through all of the n column control circuits, causes the edge $E_4$ of the fall of (f) $SP_b$ to occur. Therefore, it is ensured that the edge $E_4$ of the fall in (f) $SP_b$ occurs after the edge $E_3$ of the fall in (g) $P_4$ in all of the n column control circuits. Referring back to FIG. 1, a part 41 surrounded by broken lines, i.e., three column control circuits constituting a single set for RGB among the column control circuit group 2 and one stage of the sampling-signal generating circuit 3 can be collectively considered as a partial circuit 41. The total number of the partial circuits 41 is m. The partial circuit 41 constitutes a single circuit column. The control signals $P_1$ to $P_6$ and $P_{1r}$ and $P_{4r}$ are common to the partial circuits 41 and connected to the partial circuits 41 with their respective pieces of wiring. The partial circuits 41 operate in conjunction with each other by serving as a shift register sequentially transmitting signals to sample the image signal Vdata and output it. The control signals $P_1$ to $P_6$, which is part of the control signals, are generated by the control-signal generating circuit 4 in synchronization with each other and connected to first ends of the pieces of wiring horizontally crossing the circuit columns. The delayed control signals $P_{1r}$ and $P_{4r}$ are also connected to the same first ends. In the foregoing, the driving circuit for use in the display apparatus is described as the circuit device. However, the present invention is not limited to this. The present invention is also applicable to a case in which, in a circuit device that includes collectively operating first and second circuits, similar to the column control circuit group 2 and the sampling-signal generating circuit 3 in the present embodiment, part of control signals of the second circuit is input so as to be delayed from the other control signals. As described above, in the present invention, in circuit operation, a control signal to be input in advance is retrieved from the circuit farthest from the signal input terminal, and a control signal to be input so as to be delayed is generated by use of the retrieved control signal as its input. Therefore, malfunction of each circuit can be reduced, and stable operation is achieved.

Figure 4:
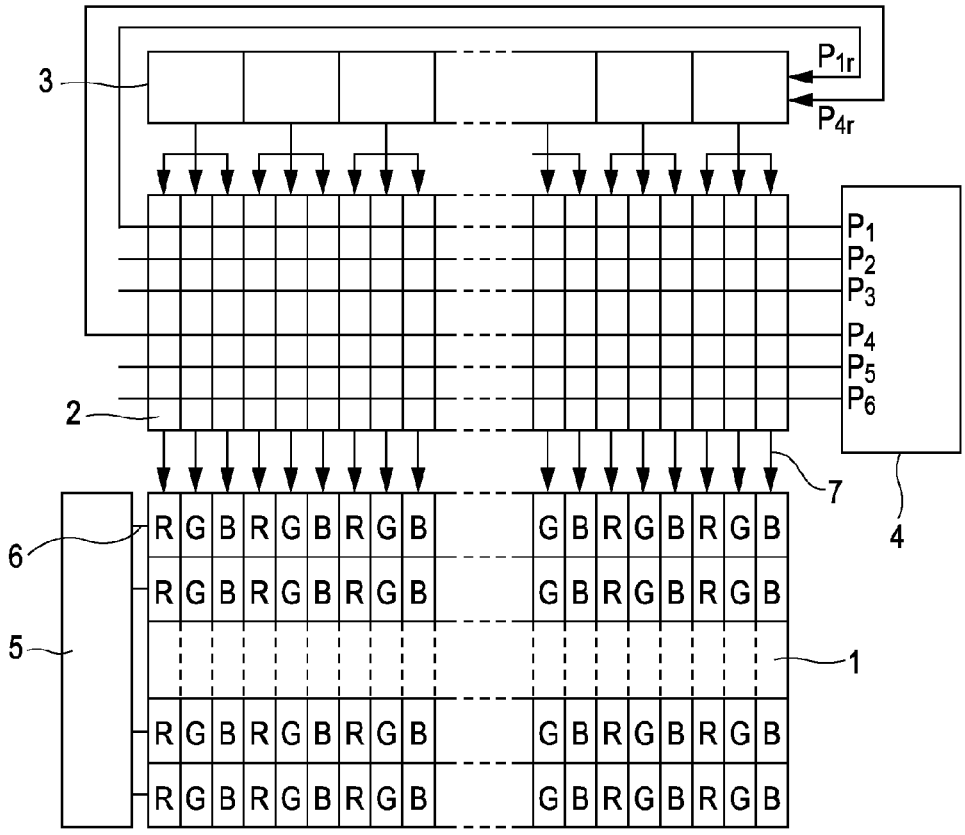
FIG. 4 illustrates another example circuit configuration of the display apparatus according to the first embodiment.

FIG. 4 illustrates another example configuration of the circuit device according to the present embodiment. FIG. 4 differs from FIG. 1 in the routing of inputting the control signals $P_{1r}$ and $P_{4r}$ into the sampling-signal generating circuit 3. In FIG. 1, the signal line is routed between the column control circuit group 2 and the sampling-signal generating circuit 3. In this region, the sampling signals $SP_a$ and $SP_b$ and the image signal Video (not shown) are arranged. Therefore, these signal lines intersect many of the other signal lines, so parasitic impedance is increased. In contrast, in FIG. 4, the signal lines are routed outside the sampling-signal generating circuit 3, i.e., in a more outer region in the display apparatus. This can reduce the intersection with the other signal lines. Therefore, interference in between the signal lines can be reduced. In the circuit configuration illustrated in FIG. 1, because the signal lines can be highly integrated, the size of the region surrounding the image display portion (picture-frame region) can be reduced. As a result, it is advantageous for miniaturization of the display apparatus.

Second Embodiment

Figure 5:
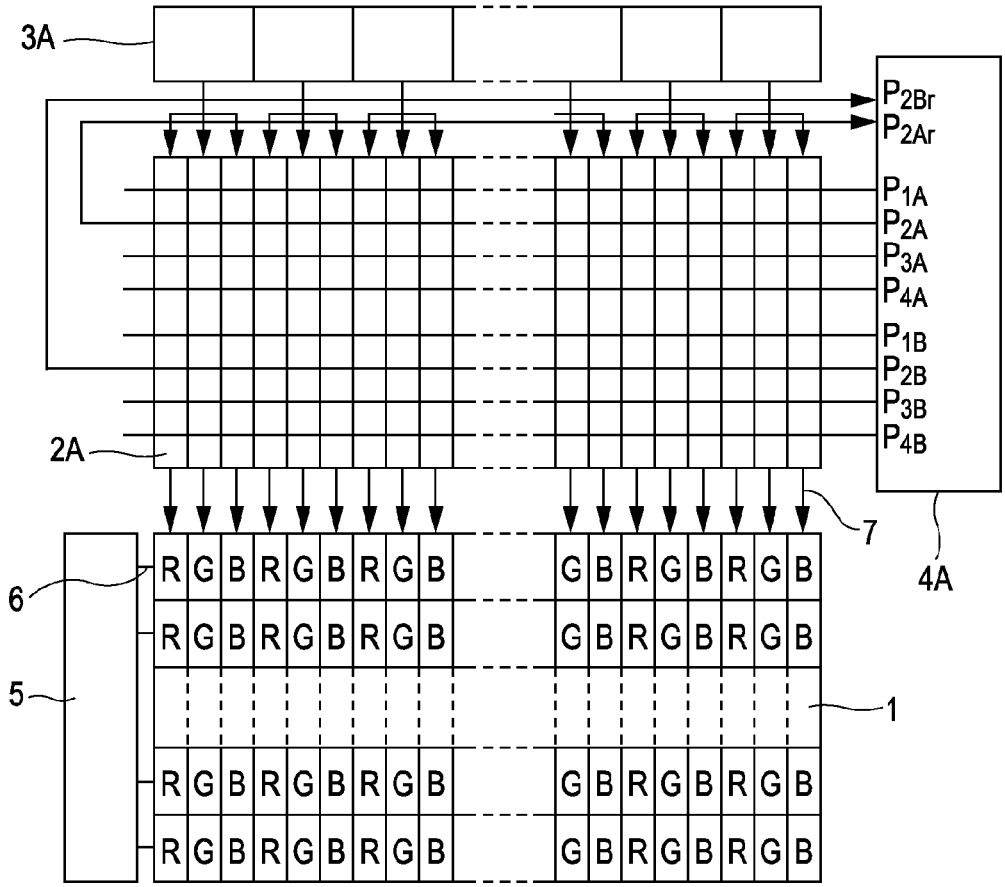
FIG. 5 illustrates an example circuit configuration of the display apparatus according to a second embodiment of the present invention.

The present embodiment is an active-matrix display apparatus including a circuit device similar to that in the first embodiment. FIG. 5 illustrates a circuit configuration of the present embodiment. In FIG. 5, reference numeral 2A represents a column control circuit group, reference numeral 3A represents a sampling-signal generating circuit, and reference numeral 4A represents a control-signal generating circuit. The control-signal generating circuit 4A corresponds to a first circuit, and the column control circuit group 2A corresponds to a second circuit.

The present embodiment is substantially the same as the first embodiment except that it includes the column control circuit group 2A, the sampling-signal generating circuit 3A, and the control-signal generating circuit 4A in place of the column control circuit group 2, the sampling-signal generating circuit 3, and the control-signal generating circuit 4, respectively.

Figure 6:
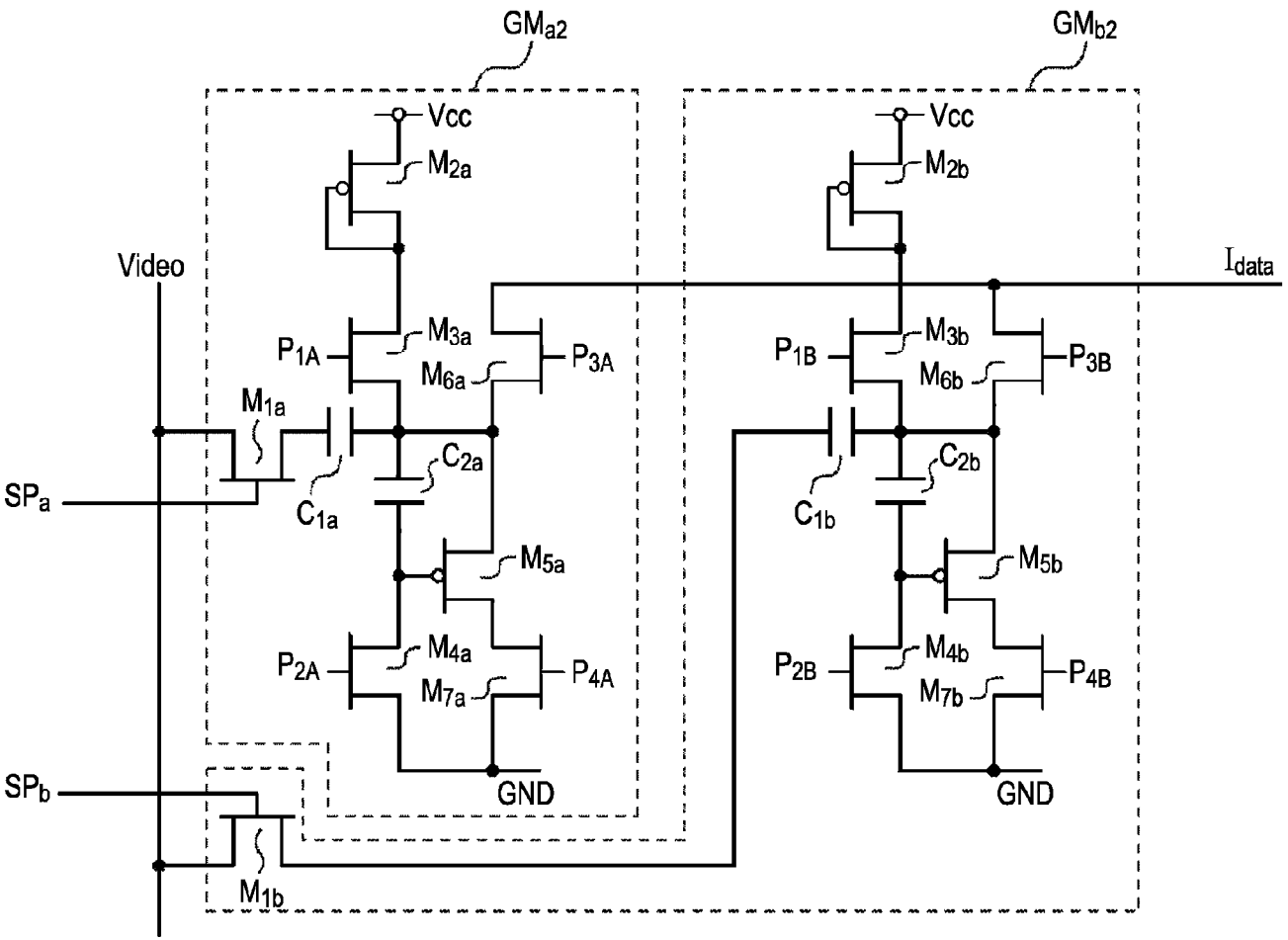
FIG. 6 illustrates a configuration of a column control circuit according to the second embodiment.

FIG. 6 illustrates a configuration of a column control circuit for one column in the present embodiment. The column control circuit illustrated in FIG. 6 includes two voltage-to-current converters $GM_{a2}$ and $GM_{b2}$. In operation, generally, while one of the two voltage-to-current converters $GM_{a2}$ and $GM_{b2}$ outputs current data, the other one samples an image signal and sets the current data. In FIG. 6, references $M_{1a}$ to $M_{4a}$, $M_{6a}$, $M_{7a}$, $M_{1b}$ to $M_{4b}$, $M_{6b}$, and $M_{7b}$ represent n-type TFTs, references $M_{5a}$ and $M_{5b}$ represent p-type TFTs, references $C_{1a}$, $C_{2a}$, $C_{1b}$, and $C_{2b}$ represent capacitors, reference GND represents a first power source, and reference VCC represents a second power source. Reference Video represents an image signal, references $SP_a$ and $SP_b$ represent sampling signals, and references $P_{1A}$ to $P_{4A}$ and $P_{1B}$ to $P_{4B}$ represent control signals. The relationship between the gate sizes (width: W, length: L) in the transistors and that between the capacitances are that $M_{1a}=M_{1b}$, $M_{2a}=M_{2b}$, $M_{3a}=M_{3b}$, $M_{4a}=M_{4b}$, $M_{5a}=M_{5b}$, $M_{6a}=M_{6b}$, $M_{7a}=M_{7b}$, $C_{1a}=C_{1b}$, and $C_{2a}=C_{2b}$.

In FIG. 6, a case in which the channel characteristic of each TFT is specified, for example, the channel characteristic of $M_{1a}$ is the n type, and that of $M_{5a}$ is the p type is described. However, this is merely an example. If the relationship between the potential of the first power source GND and that of the second power source VCC is changed or the channel characteristics of the TFTs are inverted, the configuration may be changed as needed in response to the change or inversion.

Figure 7:
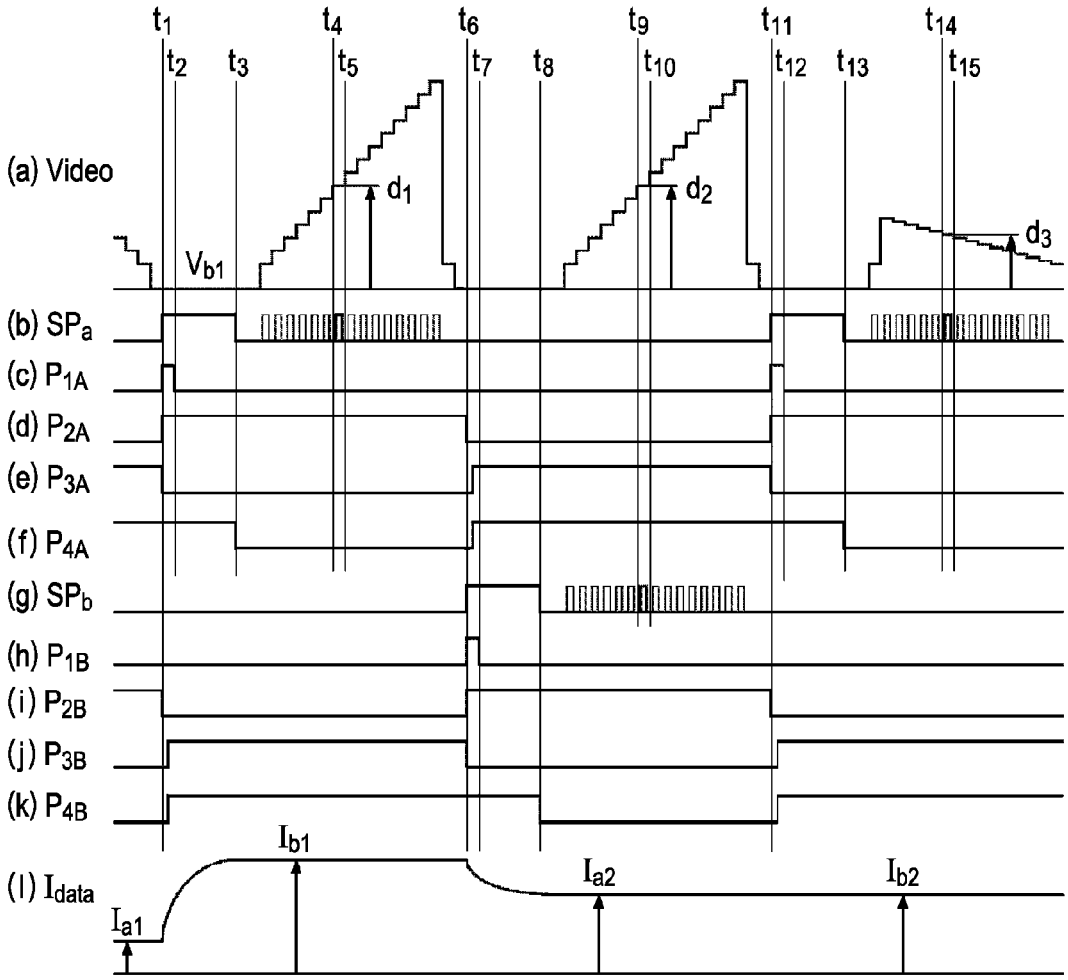
FIG. 7 is a timing diagram for describing an operation of the column control circuit illustrated in FIG. 6.

FIG. 7 is a timing diagram for describing an operation of the column control circuit illustrated in FIG. 6. FIG. 7 illustrates an operation occurring in three horizontal scanning periods for an image signal, in other words, an operation corresponding to three columns (three horizontal scanning periods) for an organic EL display apparatus. Time $t_1$ to time $t_6$ (time $t_6$ to time $t_{11}$) correspond to one horizontal scanning period.

The operation will be described below with reference to FIG. 7 while the attention is focused on the voltage-to-current converter $GM_{a2}$. The operation (1) to (6) described below is performed in sequence.

(1) Preliminary Charging (time $t_1$ to time $t_2$)

$C_{2a}$ is charged by $M_{2a}$.

(2) Threshold Voltage $V_{th}$ Resetting (time $t_2$ to time $t_3$)

$M_{5a}$ is self-discharged such that the voltage between the gate and the source (G-S voltage) approaches its threshold voltage $V_{th}$.

(3) Waiting for Sampling (time $t_3$ to time $t_4$)

The circuit waits in a state where the G-S voltage of $M_{5a}$ is adjacent to its threshold voltage $V_{th}$ until a sampling signal $SP_a$ is input.

(4) Sampling (time $t_4$ to time $t_5$)

The sampling signal $SP_a$ for a corresponding column is generated, and the G-S voltage of $M_{5a}$ maintained adjacent to its threshold voltage $V_{th}$ is changed by an image signal level $d_1$ with reference to a blanking level at this point in time.

(5) Waiting for Outputting (time $t_5$ to time $t_6$)

The circuit waits in a state where the G-S voltage of $M_{5a}$ set by sampling of the image signal is maintained.

(6) Current Outputting (time $t_6$ to time $t_{11}$)

The current of $M_{5a}$/D driven by the G-S voltage of $M_{5a}$ is output to $I_{data}$ as current data.

After (6) (on and after time $t_{11}$), the same operation is repeated from (1). The voltage-to-current converter $GM_{b2}$ outputs a current (operation (6)) during the period from (1) to (5) (time $t_1$ to time $t_6$) and performs the operation (1) to (5) relating to setting of current data during the period (6) (time $t_6$ to time $t_{11}$).

One example of the timing control in this operation for the column control circuit is control of causing the edge of the rise of the control signal $P_{3A}$ and that of $P_{4A}$ to occur after the edge of the fall of $P_{2A}$ at time $t_6$. This control is performed for stable operation of outputting a current with the G-S voltage of $M_{5a}$ set by sampling of an image signal by turning-on of $M_{6a}$ and $M_{7a}$ after turning-off $M_{4a}$ (the same applies to the operation at time $t_{11}$). That is, in the present embodiment, the control signals $P_{2A}$ and $P_{2B}$ correspond to a first control signal for a driving circuit according to the present invention, and the control signals $P_{3A}$, $P_{4A}$, $P_{3B}$, and $P_{4B}$ correspond to a second control signal for the driving circuit according to the present invention.

In FIG. 5, the control-signal generating circuit 4A outputs the control signals ($P_{1A}$ to $P_{4A}$ and $P_{1B}$ to $P_{4B}$) having the waveforms illustrated in FIG. 7 and inputs them into the column control circuit group 2A. When the pixels are arranged in n columns, n column control circuits are arranged. The control signals ($P_{1A}$ to $P_{4A}$ and $P_{1B}$ to $P_{4B}$) input into the n column control circuits are common thereto. After the control signals are output from the control-signal generating circuit 4A, the signals are propagated from the nearest column control circuit toward the farthest column control circuit (from right to left in FIG. 5).

After the control signals $P_{2A}$ and $P_{2B}$ are propagated to the farthest column control circuit (in FIG. 5, the column control circuit at the leftmost side of the column control circuit group 2A), these control signals are returned to the control-signal generating circuit 4A through the routed signal lines. The control signals $P_{2A}$ and $P_{2B}$ after passing through the routed signal lines are represented by control signals $P_{2Ar}$ and $P_{2Br}$.

Figure 8:
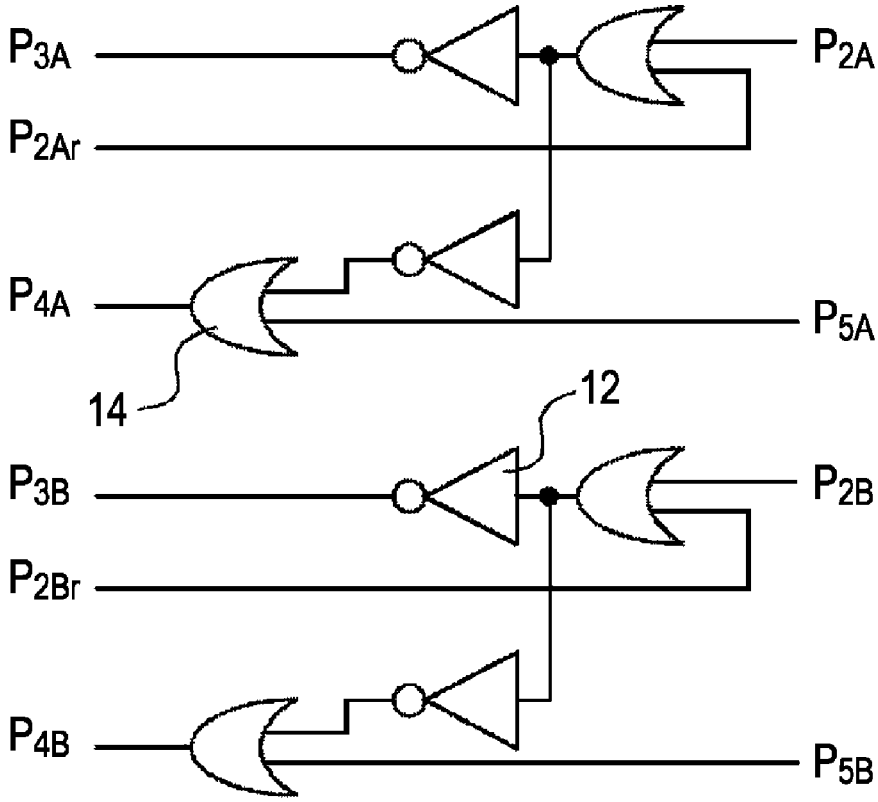
FIG. 8 illustrates part of a signal generating circuit according to the second embodiment.

FIG. 8 illustrates one example of part of the control-signal generating circuit 4A. Each of the control signals $P_{2A}$, $P_{2B}$, $P_{2Ar}$, and $P_{2Br}$ is input into the logic circuit constituted by the inverter 12 and the OR gate 14. The logic circuit outputs the control signals $P_{3A}$, $P_{4A}$, $P_{3B}$, and $P_{4B}$. The control signals $P_{5A}$ and $P_{5B}$ are used for generating the control signals $P_{4A}$ and $P_{4B}$.

Figure 9:
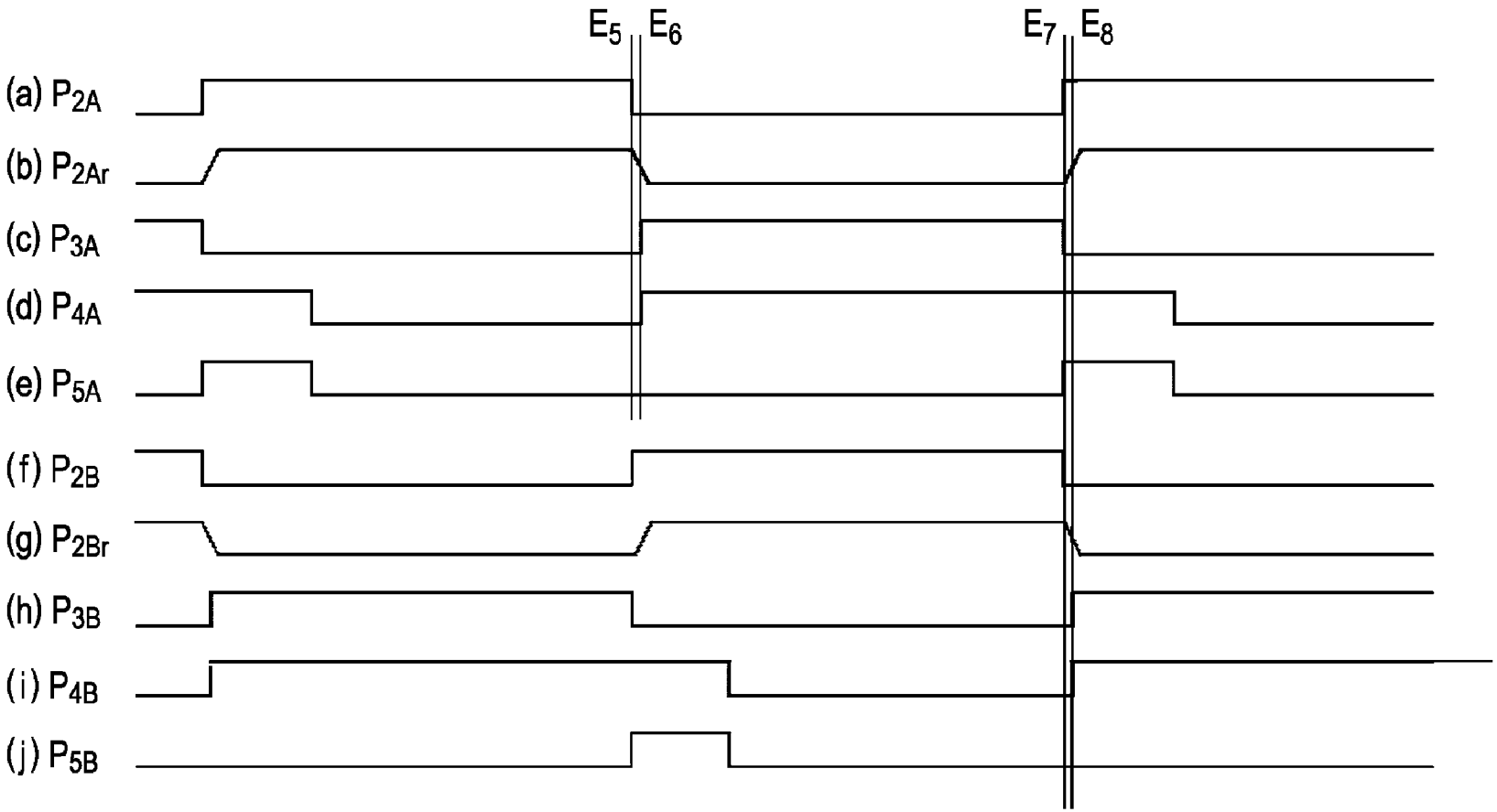
FIG. 9 is a timing diagram for describing an operation of the part of the signal generating circuit illustrated in FIG. 8.

FIG. 9 is a timing diagram that illustrates an operation of the part of the control-signal generating circuit 4A illustrated in FIG. 8. In FIG. 9, (a) to (j) represent the waveforms at the nodes of the symbols illustrated in FIG. 8. (a) represents the waveform of $P_{2A}$, (b) represents that of $P_{2Ar}$, (c) represents that of $P_{3A}$, (d) represents that of $P_{4A}$, (e) represents that of $P_{5A}$, (f) represents that of $P_{2B}$, (g) represents that of $P_{2Br}$, (h) represents that of $P_{3B}$, (i) represents that of $P_{4B}$, and (j) represents that of $P_{5B}$. The waveforms of (e) $P_{5A}$ and (j) $P_{5B}$ are not limited to those illustrated in FIG. 9. They may have any form as long as they can generate the H level of $P_{4A}$ during the period from time $t_2$ to time $t_3$ illustrated in FIG. 7 and during the period from $t_{12}$ to time $t_{13}$ and the H level of $P_{4B}$ during the period from time $t_7$ to time $t_8$. Because the signals (b) $P_{2Ar}$ and (g) $P_{2Br}$ have been propagated through the n column control circuits, the rise and the fall in their waveforms are less steep, and the signals (b) $P_{2Ar}$ and (g) $P_{2Br}$ are delayed from the signals (a) $P_{2A}$ and (f) $P_{2B}$.

In such a way, the edge of the fall of (b) $P_{2Ar}$, which is the signal in which the fall of (a) $P_{2A}$ has been reliably propagated through all of the n column control circuits, causes the edge of the rise of (c) $P_{3A}$ and that of (d) $P_{4A}$ to occur. Therefore, it is ensured that the edge $E_6$ of the rise in (c) $P_{3A}$ and that in (d) $P_{4A}$ occurs after the edge $E_5$ of the fall in (a) $P_{2A}$ in all of the n column control circuits. Additionally, the edge of the fall in (g) $P_{2Br}$, which is the control in which the fall of (f) $P_{2B}$ has been reliably propagated through all of the n column control circuits, causes the edge of the rise in (h) $P_{3B}$ and that in (i) $P_{4B}$ to occur. Therefore, it is ensured that the edge $E_8$ of the rise in (h) $P_{3B}$ and that in (i) $P_{4B}$ occurs after the edge $E_7$ of the fall in (f) $P_{2B}$ in all of the n column control circuits.

Figure 10:
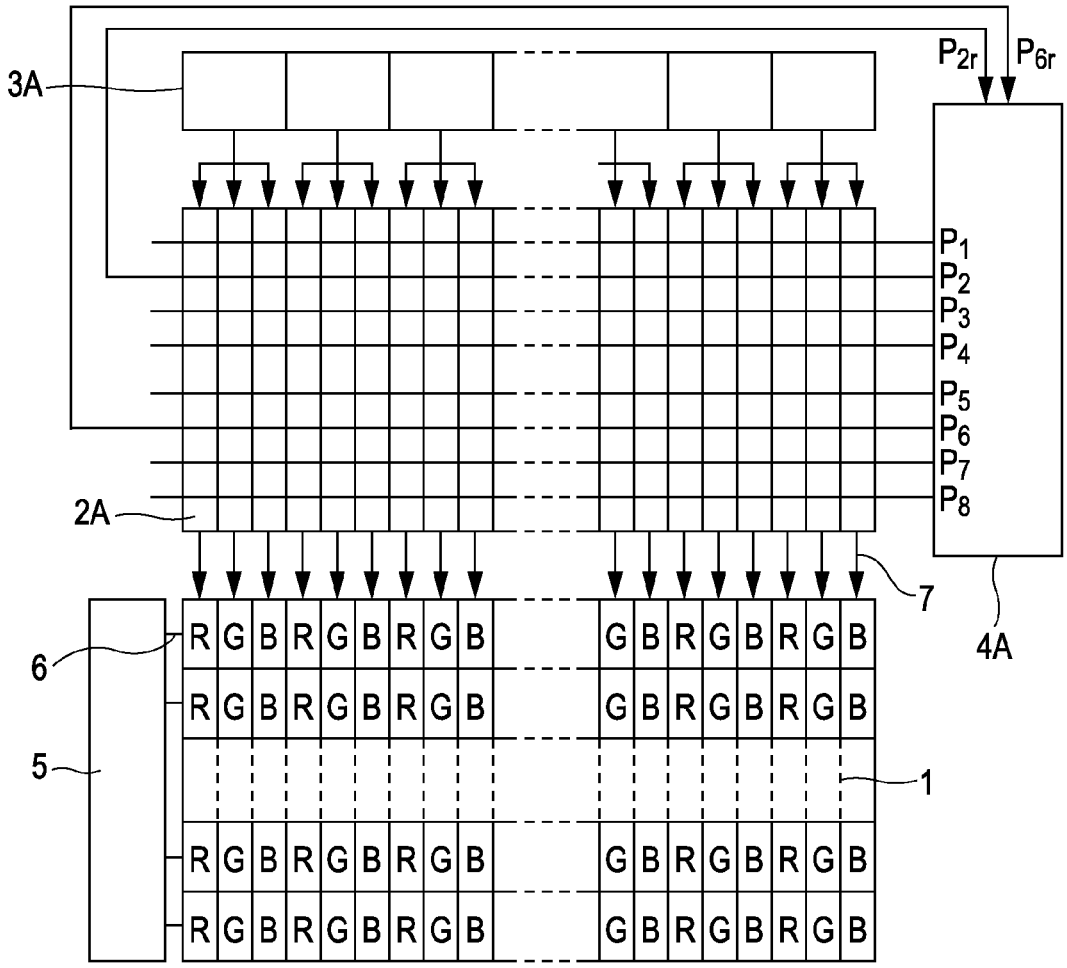
FIG. 10 illustrates another example circuit configuration of the display apparatus according to the second embodiment.

FIG. 10 illustrates another circuit configuration of the display apparatus according to the present embodiment. FIG. 10 differs from FIG. 5 in the routing in which the control signals $P_{2Ar}$ and $P_{2Br}$ are input into the control-signal generating circuit 4A. In FIG. 5, the signal lines are routed between the column control circuit group 2A and the sampling-signal generating circuit 3A, and in this region, the sampling signals $SP_a$ and $SP_b$ and the image signal Video (not shown) are arranged. Therefore, these signal lines intersect many of the other signal lines, so parasitic impedance is increased. In contrast, in FIG. 10, the signal lines are routed outside the sampling-signal generating circuit 3A, i.e., in a more outer region in the display apparatus. This can reduce the intersection with the other signal lines. Therefore, interference in between the signal lines can be reduced. In the circuit configuration illustrated in FIG. 5, because the signal lines can be highly integrated, the size of the region surrounding the image display portion (picture-frame region) can be reduced. As a result, it is advantageous for miniaturization of the display apparatus.

The above-described embodiments are applicable to an electronic apparatus.

Figure 11:
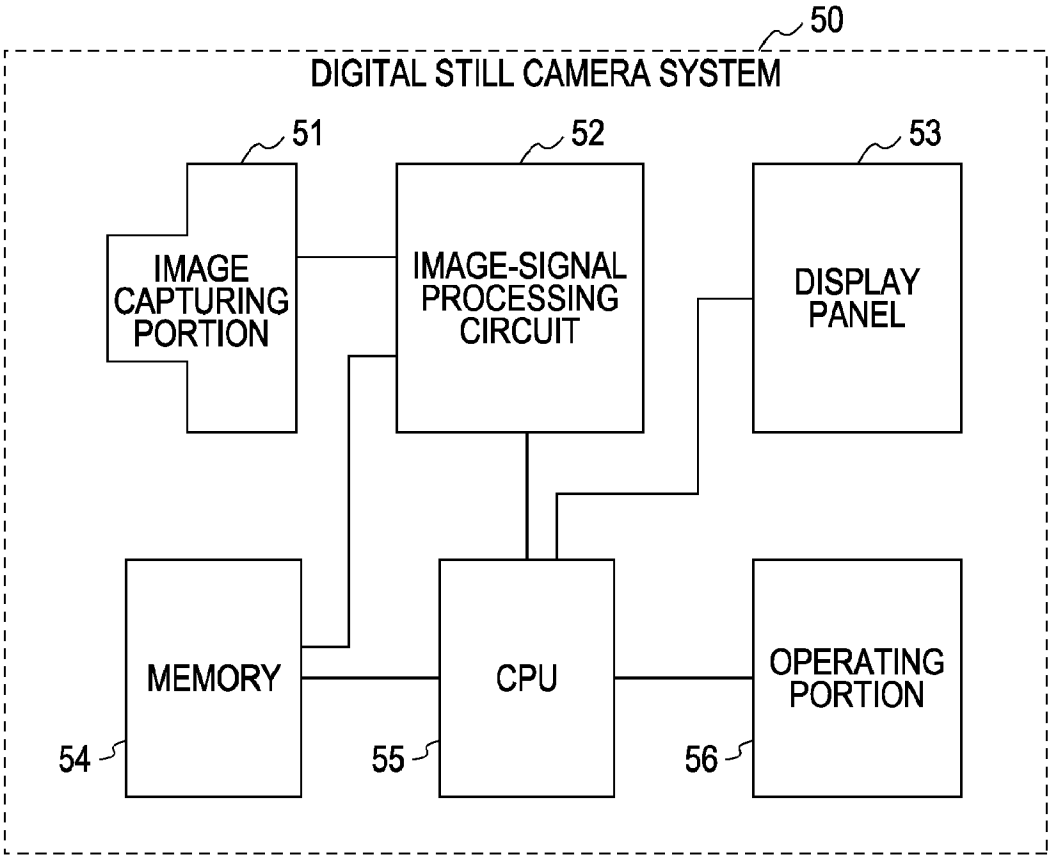
FIG. 11 is a block diagram that illustrates a general configuration of a digital still camera system that uses a display apparatus according to an aspect of the present invention.

FIG. 11 is a block diagram that illustrates one example of a digital still camera system to which at least one of the above-described embodiments is applied. In this drawing, reference numeral 50 represents a digital still camera system, reference numeral 51 represents an image capturing portion, reference numeral 52 represents an image-signal processing circuit, reference numeral 53 represents a display panel, reference numeral 54 represents a memory, reference numeral 55 represents a central processing unit (CPU), and reference numeral 56 represents an operating portion.

In FIG. 11, an image captured by the image capturing portion 51 or an image recorded on the memory 54 can be signal-processed by the image-signal processing circuit 52 and can be displayed on the display panel 53. The CPU 55 controls the image capturing portion 51, the memory 54, the image-signal processing circuit 52, and other components in response to input from the operating portion 56 and performs imaging, recording, reproducing, and displaying as circumstances demand. The display panel 53 can also be used as a display portion of other electronic apparatuses.

The driving circuit and the display apparatus using the driving circuit according to the embodiments of the present invention are described above. The present invention relates to a driving circuit including a TFT and to an active-matrix display apparatus using the driving circuit. In particular, the present invention is applicable to an active-matrix display apparatus using organic EL elements. An information processing apparatus can be constructed by the use of this display apparatus, for example. The display apparatus is applicable to, for example, a television system, a personal computer, a cellular phone, a personal digital assistant (PDA), a still camera, a video camera, a camcorder, a portable music player, and a car navigation system. The display apparatus is also applicable to an apparatus achieving a plurality of functions of theses apparatuses. The information processing apparatus includes an information input portion. For example, in the case of a cellular phone, the information input portion includes an antenna. In the case of a PDA or a portable PC, the information input portion includes an interface portion to a network. In the case of a digital camera or a camcorder, the information input portion includes a sensor portion composed of a charge-coupled device (CCD) or complementary metal-oxide semiconductor (CMOS).

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-280441 filed Oct. 29, 2007, which is hereby incorporated by reference herein in its entirety.

What is claimed is:

1. An active-matrix display apparatus comprising:

an image display unit in which pixels are arranged in a matrix in row and column directions;

a column control circuit group including thin-film transistors, the column control circuit group being configured to output a data signal to columns of the pixels; and a control-signal generating circuit including a thin-film transistor, the control-signal generating circuit being configured to output a first control signal controlling the column control circuit group, wherein the column control circuit group is controlled by the first control signal and a second control signal delayed from the first control signal, the first control signal is generated by the control-signal generating circuit, then input into the column control circuit group, and then propagated through the column control circuit group, and the second control signal is generated on the basis of the first control signal which has been propagated through the column control circuit group.

2. The active-matrix display apparatus according to claim 1, further comprising a sampling-signal generating circuit, including a thin-film transistor, for generating a sampling signal in response to propagating the first control signal through the column control circuit group into the sampling-signal generating circuit, wherein the second control signal is a sampling signal sampling an image signal input into the active-matrix display apparatus.

3. The active-matrix display apparatus according to claim 1, wherein the control-signal generating circuit is configured to generate the second control signal on the basis of the first control signal propagated through the column control circuit group.

4. The active-matrix display apparatus according to claim 1, wherein the second control signal common to all of the column control circuit group is input thereinto.

5. The active-matrix display apparatus according to claim 1, wherein each of the pixels includes an organic electroluminescent element.

6. The active-matrix display apparatus according to claim 5, further comprising a sampling-signal generating circuit, including a thin-film transistor, for generating a sampling signal in response to propagating the first control signal through the column control circuit group into the sampling-signal generating circuit, wherein the second control signal is a sampling signal sampling an image signal input into the active-matrix display apparatus.

7. An electronic apparatus comprising the active-matrix display apparatus according to claim 1.

8. The active-matrix display apparatus according to claim 1, wherein the second control signal common to all of the column control circuit group is input thereinto.

* * * * *